US005990836A

United States Patent [19]

Bhattacharyya

[11] Patent Number: 5,990,836

[45] Date of Patent: Nov. 23, 1999

[54] MULTI-LAYERED PATCH ANTENNA

[75] Inventor: Arun K. Bhattacharyya, El Segundo, Calif.

[73] Assignee: Hughes Electronics Corporation, El Segundo, Calif.

[21] Appl. No.: 09/220,128

[22] Filed: Dec. 23, 1998

[51] Int. Cl.[6] ..... H01Q 1/38

[52] U.S. Cl. ..... 343/700 MS; 343/829

[58] Field of Search ..... 343/700 MS, 786, 343/829, 846, 848, DIG. 2

[56] References Cited

U.S. PATENT DOCUMENTS

| | | | |
|---|---|---|---|
| 5,453,751 | 9/1995 | Tsukamoto et al. | 343/700 MS |
| 5,510,803 | 4/1996 | Ishizaka et al. | 343/700 MS |
| 5,661,494 | 8/1997 | Bondyopadhyay | 343/700 MS |

*Primary Examiner*—Don Wong
*Assistant Examiner*—Tan Ho
*Attorney, Agent, or Firm*—Georgann S. Grunebach; M.W. Sales

[57] ABSTRACT

An antenna structure is formed of a first patch plane, a first ground plane, a feed member plane, a second ground plane, and a second patch plane all spaced apart by layers of laminated dielectric substrate. A horn transmits energy upon the second patch plane. The energy is controlled in terms of phase and frequency, and is further electromagnetically coupled to the first patch plane which transmits in the form of shaped or pencil beams. The coupling between patch planes is accomplished by an array of slots located through the ground planes and an array of feed members interposed between the ground planes. The phase differences are established by utilization of feed members with different lengths.

20 Claims, 4 Drawing Sheets

MULTI-LAYERED PATCH ANTENNA

TECHNICAL FIELD

This invention relates to microstrip patch antennas and to arrays of such antennas and, more particularly, to a horn fed array for the generation of shaped or pencil beams.

BACKGROUND ART

In satellite applications, lens antennas are utilized to form shaped or pencil beams. Typically, an array of unit cells are formed on a single lens comprising a dielectric substrate with one or more conducting layers. The unit cells have stripline feed members which channel electromagnetic waves. The stripline feed members vary in length in order to provide appropriate phase differences required to generate the shaped/pencil beam. The electromagnetic radiation to be received or transmitted is typically provided directly to the feed member in the form of electrical power. The phase versus frequency characteristic of each unit cell is preferably linear in order to maintain the desired beam shape over a range of frequencies.

A problem arises, however, in feeding the stripline feed members with electromagnetic radiation. Known devices use direct electrical connections between a radiating source and the feed members to permit transmission. As an example, a typical bootlace lens requires direct electrical connections between a feeding patch layer, the feed members, and a transmitting patch layer. Such connections, or probes, are difficult and expensive to manufacture. Furthermore, these probes produce temperature stability concerns. Accordingly, there exists a need for a simplified lens structure capable of transmitting and receiving shaped or pencil beams, which has simplified construction.

SUMMARY OF THE INVENTION

The present invention discloses a novel horn-fed, multi-layered, patch antenna which is capable of transmitting and receiving shaped or pencil beams without the need for direct electrical connections. The inventive antenna includes an array of unit cells. Each unit cell includes a transmitting patch, located on a first patch plane, and a feeding patch located on a second patch plane. Interposed between these patches are two ground planes each containing corresponding slots. The ground planes are separated by feed members which further correspond with the slots of both ground planes. These components are all configured within a dielectric substrate.

In operation, the horn emits electromagnetic waves which strike the second patch plane. The energy is coupled between the second and first patch planes via the slots and feed members. The feed members vary in length, or size, in order to provide appropriate phase differences required to generate the desired shaped or pencil beams. Since the feed members propagate in the transverse electromagnetic (TEM) mode, the phase versus frequency characteristic of each unit cell (patch-slot-feed-member-slot-patch) is linear. This has the advantage of maintaining the beam shape over a range of frequencies.

The ability of the present invention to couple energy from the second patch plane to the first, via slots and feed members, eliminates the drawbacks of the previous art. Specifically, direct connections are no longer necessary to couple the feed patches to the transmitting patches or the feed members. The present invention thus has the further advantage of eliminating the need for layer piercing probes thereby simplifying the antenna manufacture. In addition, the elimination of the probe connection enhances temperature stability.

Other advantages of the inventive antenna over prior art is its flat structure, and light weight, making it ideal for packaging within a satellite application. The linear phase versus frequency characteristics make wide band applications possible and the antenna's center-fed structure helps to eliminate dispersion problems.

Additional advantages and features of the present invention will be apparent from the following detailed description when taken in view of the attached drawings and the claims appended hereto.

BRIEF DESCRIPTION OF THE DRAWINGS

For a more complete understanding of the invention, reference should now be had to the embodiments illustrated in greater detail in the accompanying description and drawings, in which.

BEST MODE(S) FOR CARRYING OUT THE INVENTION

Figure 1:
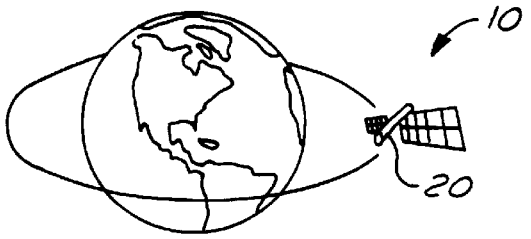
FIG. 1 is a lens antenna structure within a satellite environment.

The present invention will be described in terms of its operation in a transmit mode. Due to the principle of reciprocity, the invention works the same in a reverse order for the receive mode. Referring to FIG. 1, a lens antenna structure 20 is preferred for use in a satellite 10 application as a result of its low profile and ease in which it can be configured to specialized geometries. Structure 20 is a horn-fed, multi-layered, printed circuit lens antenna particularly suited for shaped or pencil beams in the Ku and Ka bands.

Figure 2:
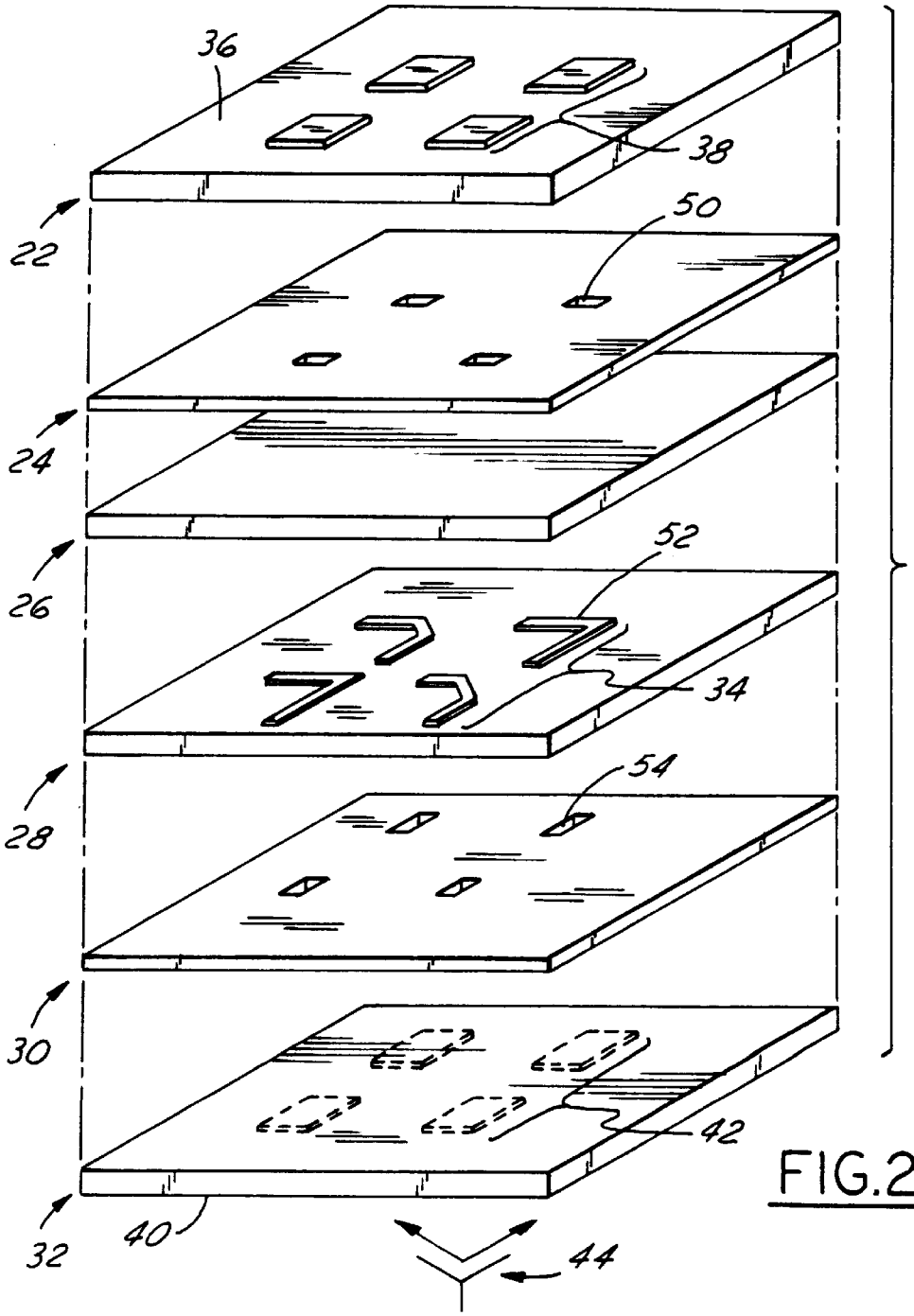
FIG. 2 is an exploded perspective view of a partial lens antenna structure in accordance with an embodiment of the present invention.

Referring to FIG. 2, one embodiment of the lens antenna structure 20 is composed of a series of stacked layers. A first dielectric layer 22 is positioned adjacent to a first ground plane 24 which in turn is positioned adjacent to a second dielectric layer 26. The second dielectric layer 26 is positioned adjacent to a third dielectric layer 28 which in turn is adjacent to a second ground plane 30. The second ground plane 30 is positioned adjacent to a fourth dielectric layer 32.

Interposed between the second dielectric layer 26 and the third dielectric layer 28 is a feed member plane 34. In addition, positioned on a top surface 36 of the first dielectric layer 22 is a first patch plane 38, and positioned on a bottom surface 40 of the fourth dielectric layer 32 is a second patch plane 42. In addition, slots 50, 54 are arranged in the first and second ground planes 24, 30 respectively. Feed members 52 corresponding to slots 50, 54 are arranged in the third dielectric layer 28.

In operation, the feed members 52 capacitively and electromagnetically couple the first and second patch planes 38, 42. A horn 44, remotely positioned below the second patch plane 42, emits electromagnetic energy in the direction of the antenna structure. This signal is received by the second patch plane 42, converted to TEM waves by the slots 50, 54 and feed members 52 in the intermediate ground planes 24, 30 and dielectric plane 28, and subsequently transmitted by the first patch plane 38.

Figure 3:
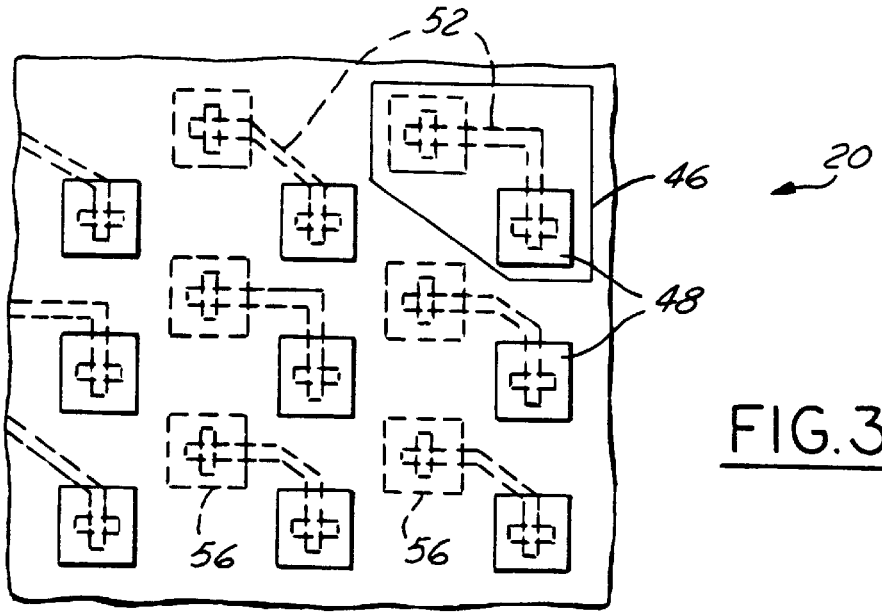
FIG. 3 is a top view of a lens antenna structure in accordance with an embodiment of the present invention.

FIG. 3 is a top view of a lens antenna structure 20 in accordance with one embodiment of the present invention. As shown in FIG. 3, the lens antenna structure 20 comprises a plurality of unit cells 46. A unit cell 46 is shown in further detail in FIG. 4.

Figure 4:
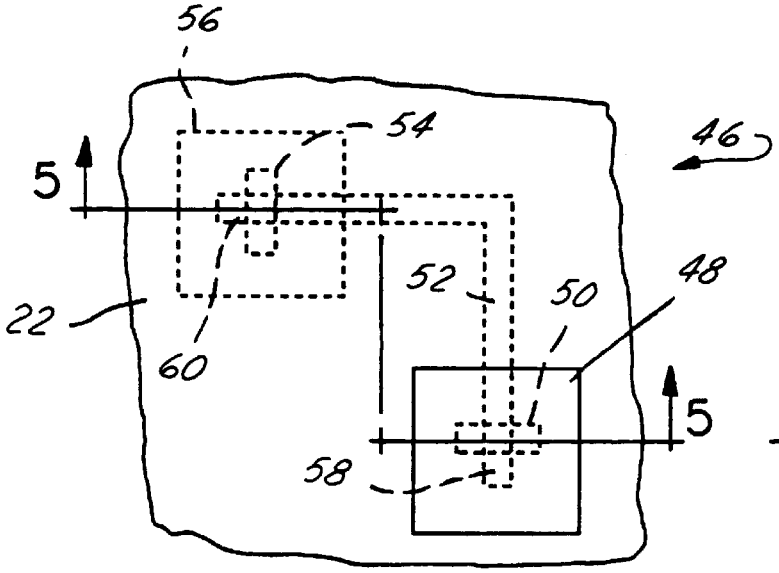
FIG. 4 is an embodiment of a unit cell.

As shown in FIG. 4, each unit cell 46 contains a portion of the layers and planes mentioned above. Each unit cell 46 comprises a first patch 48 from the first patch plane 38, a top slot 50 from the first ground plane 24, a feed member 52 from the feed member plane 34, a bottom slot 54 from the second ground plane 30, and a second patch 56 from the second patch plane 42. Each of the elements comprising the unit cell 46 are separated by a dielectric substrate.

Figure 5:
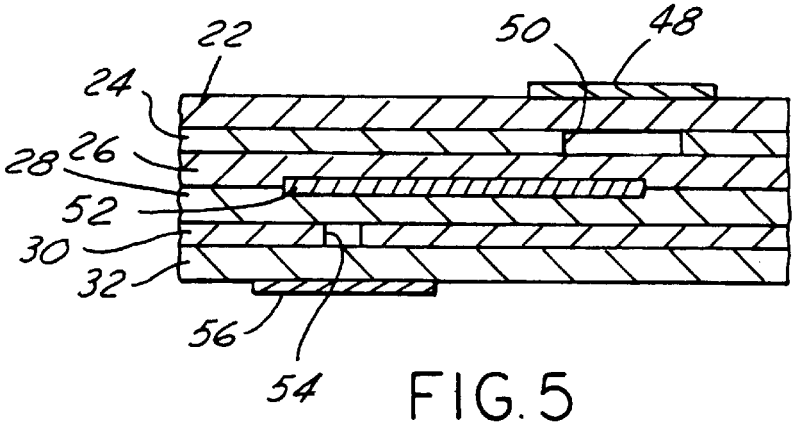
FIG. 5 is a partial cross sectional view of the unit cell of FIG. 4 taken along line 4—4.

As shown in FIG. 5, patch 48 is separated from slot 50 by the first dielectric layer 22; slot 50 is separated from feed member 52 by the second dielectric layer 26; feed member 52 is separated from slot 54 by the third dielectric layer 28; and slot 54 is separated from the second patch 56 by the fourth dielectric layer 32.

Referring again to FIG. 4, the first patch 48 is substantially centered over the top slot 50, and the second patch 56 is centered beneath the bottom slot 54. The first patch 48 is off-centered from the second patch 56. The feed member 52 has a first end 58 positioned substantially perpendicular to the top slot 50, and a second end 60 positioned substantially perpendicular to the bottom slot 54. The feed member ends 58 and 60 extend to, and slightly beyond, the slots 50 and 54, respectively.

In operation, the second patch 56 receives electromagnetic energy from the horn 44. Patch 56 radiates a frequency band centered at the second patch 56 resonance frequency. This radiation induces an electric field in the bottom slot 54 which extends transversely to the long dimension of the slot 54. This electric field creates a TEM wave which travels along feed member 52. This wave induces a second electric field in the top slot 50 which, in turn, excites first patch 48 at its resonating frequency. First patch 48 then transmits a frequency band centered about its resonating frequency.

Figure 9:
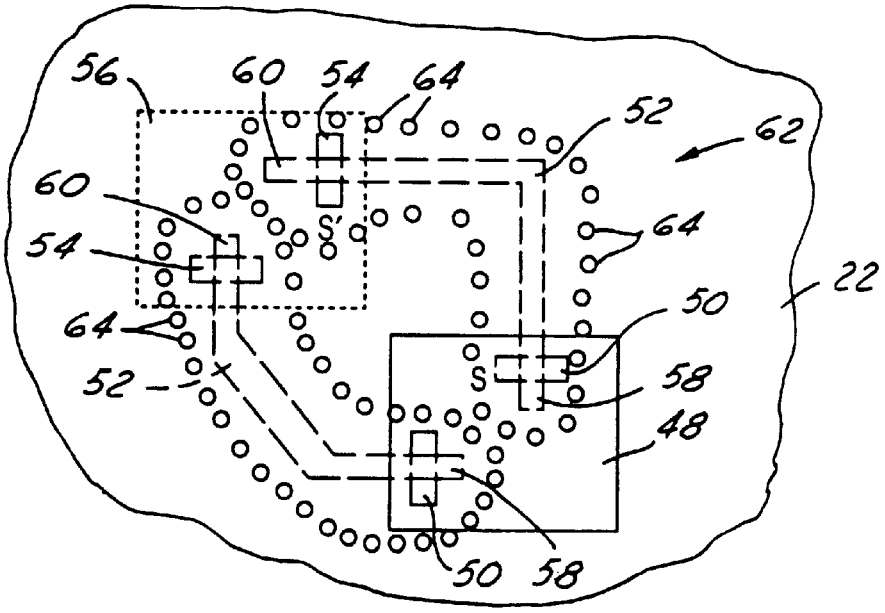
FIG. 9 is another embodiment of a unit cell.

The feed member 52 can be configured in different shapes. For example, the feed member 52 may be straight, so that the associated top slot 50 is parallel with the associated bottom slot 54, or the feed member 52 may be bent as shown in FIG. 9. The preferred shape of the feed member 52 is a shape which positions the first end 58 orthogonal to the second end 60. Such a feed member shape permits variations of feed member lengths from one unit cell 46 to the next within the same array in a spacially efficient fashion. In addition, the orthogonal positioning of the first end 58 to the second end 60 simplifies manufacturing and reduces associated costs since the same patch plane pattern may be utilized for both the first patch plane 38 and the second patch plane 42. Likewise, the same ground plane pattern may be utilized for the first and second ground planes 24, 30.

Figure 6:
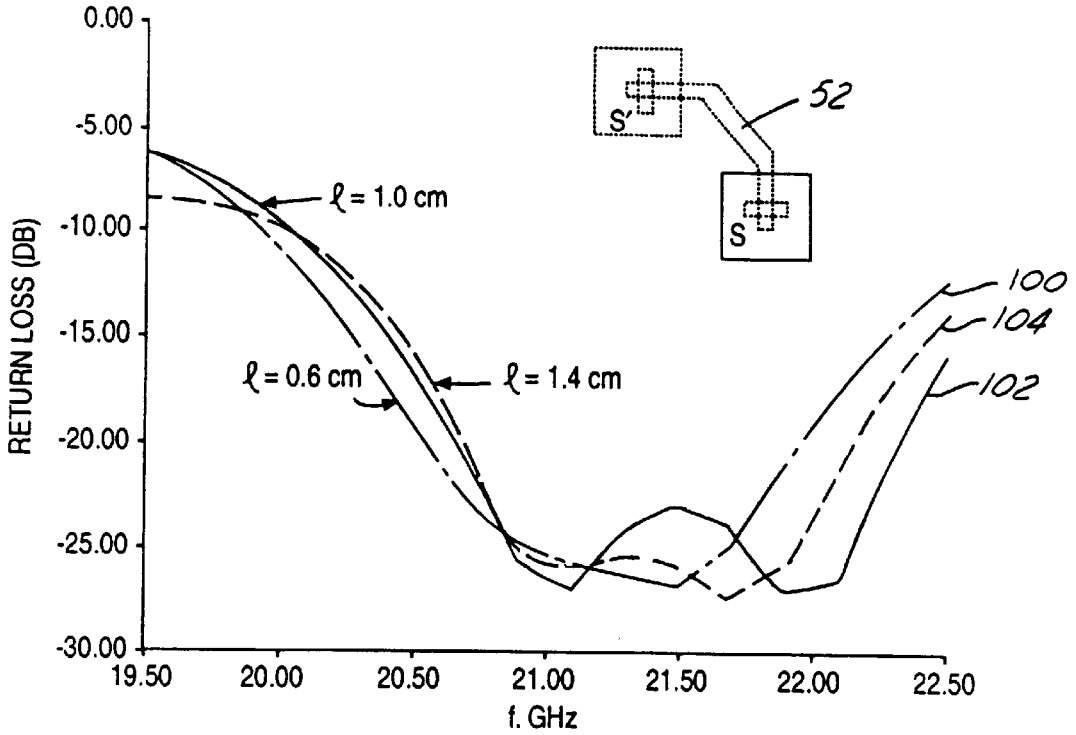
FIG. 6 is a graph of return loss versus frequency of three different unit cells in accordance with an embodiment of the present invention.

Referring to FIG. 6, "l" represents the distance from "s" to "s'" along the feed member 52. The slot and patch dimensions are designed to provide good return loss. For example, with first and second patch dimensions of 0.5 cm×0.5 cm, unit cell size of 0.88 cm×0.88 cm, top and bottom slot size of 0.4 cm×0.05 cm, first and fourth dielectric layer thicknesses of 0.1 cm with dielectric constant of 1.1, and second and third dielectric layer thicknesses of 0.038 cm with a dielectric constant of 2.53, the −15 dB return loss bandwidth is approximately 10%. This is true whether l=0.6 cm as shown in line 100, or l=1.0 cm as shown in line 102, or l=1.4 cm as shown in line 104.

Figure 7:
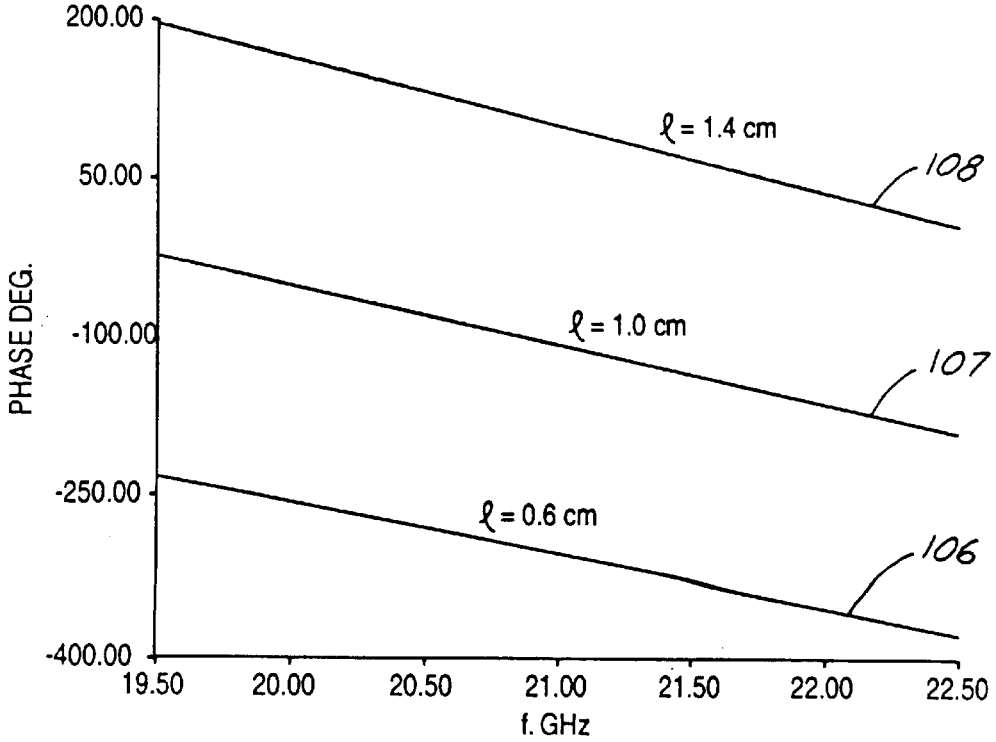
FIG. 7 is a graph of phase versus frequency of three unit cells in accordance with an embodiment of the present invention.

As shown in FIG. 7, the feed member 52 propagates in the TEM mode, therefore the phase versus frequency characteristic of the unit cell 46 is linear (lines 106, 107, 108). Thus, the beam shape can be maintained over a range of frequencies.

The transmitted bandwidth can be increased by using thicker substrate for the first and fourth dielectric layers 22, 32 and/or using stacked first patches 48. Preferably, the stacked patches are approximately equal in size so as to resonate at approximately the same frequencies, but differ enough so as to broaden the bandwidth. The dielectric substrate utilized between stacked patches will also cause broadening of the transmitted frequency bandwidth. The dielectric constant is higher for the second and third dielectric layers 26, 28 than for the first and fourth dielectric layers 22, 32 in order to provide a sufficient electromagnetic coupling between the first patch 48 and the second patch 56. Also, for a given off-set between the patch 48 and patch 56, a high dielectric substrate in the feed region provides a large dynamic range for the phase.

Figure 8:
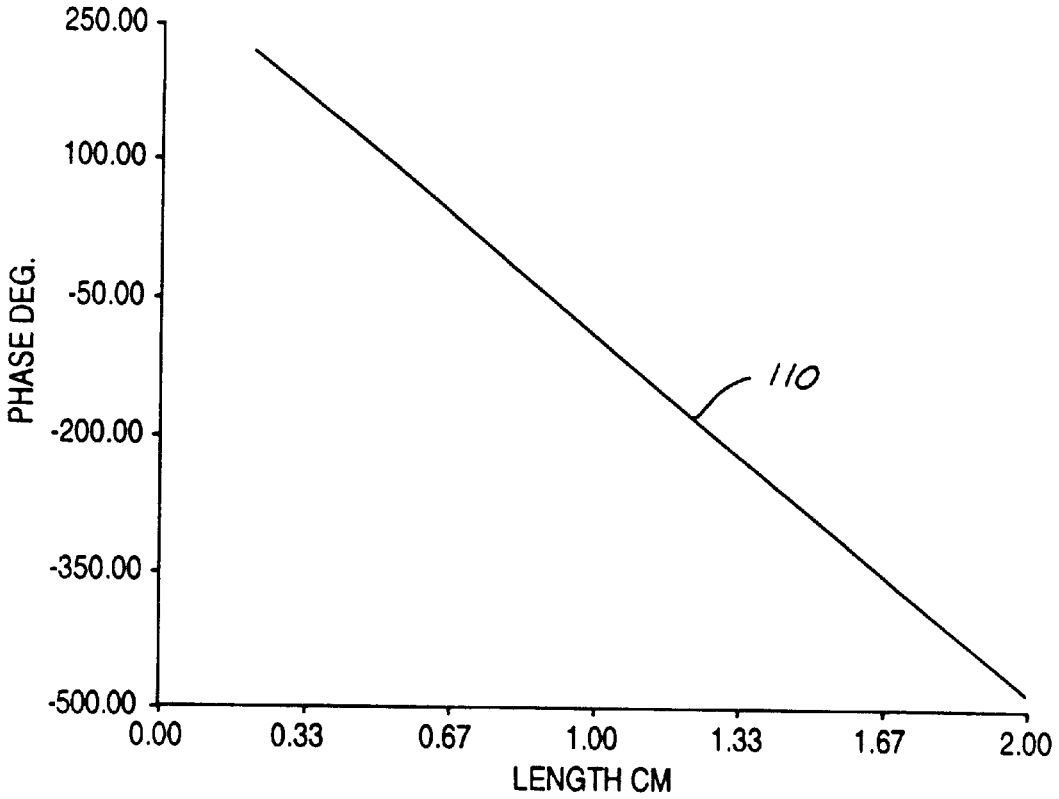
FIG. 8 is a graph of feed member length versus phase of three unit cells in accordance with an embodiment of the present invention.

In order to generate shaped or pencil beams, the lens antenna structure 20 must operate at appropriate phase differences. Phase differences are provided by varying the length of the feed member 52 from one unit cell 46 to the next. FIG. 8 illustrates the phase shift versus feed member 52 length for a representative frequency (line 110).

FIG. 9 shows another embodiment of a unit cell. A dual polarization application can be configured when utilizing a dual unit cell 62. Dual unit cell 62 is similar to unit cell 46 with an additional feed member 52 coupled with additional top and bottom slots 50, 54. The additional slots are spaced apart from, and positioned perpendicular to, the original slots. This positioning provides the preferred orthogonal coupling of electromagnetic radiation for dual polarization applications. The two polarizations are further isolated by a plurality of holes 64 plated with conductive metallic material connecting the respective ground planes in which slots 50 and 54 reside. To ensure proper isolation, the separation between the plurality of holes 64 is preferably less than 0.2 times the wavelength of the resonating frequency of the first and second patches 48 and 56.

It should be understood that the inventions herein disclosed are preferred embodiments, however, many others are possible. It is not intended herein to mention all of the possible equivalent forms or ramifications of the invention. It is understood that the terms used herein are merely descriptive rather than limiting, and that various changes may be made without departing from the spirit or scope of the invention as defined by the appended claims.

What is claimed is:

1. An antenna structure comprising:

a plurality of unit cells each having:

a first patch plane having a first patch;

a first ground plane adjacent to said first patch plane, said first ground plane having a top slot in operative communication with said first patch;

a feed member plane adjacent to said first ground plane, said feed member plane having a feed member in operative communication with said top slot;

a second ground plane adjacent to said feed member plane, said second ground plane having a bottom slot in operative communication with said feed member;

a second patch plane adjacent to said second ground plane, said second patch plane having a second patch in operative communication with said bottom slot;

a first dielectric layer interposed between said first patch plane and said first ground plane;

a second dielectric layer interposed between said first ground plane and said feed member plane;

a third dielectric layer interposed between said feed member plane and said second ground plane; and a fourth dielectric layer interposed between said second ground plane and said second patch plane.

2. The antenna structure as claimed in claim 1 wherein said feed member has a first end positioned perpendicular to and substantially under said top slot, and a second end positioned perpendicular to and substantially over said bottom slot.

3. The antenna structure as claimed in claim 2 wherein said first end and said second end are respectively positioned perpendicular to each other.

4. The antenna structure as claimed in claim 3 wherein said first patch plane and said second patch plane are symmetrically identical, and said first ground plane and said second ground plane are symmetrically identical.

5. The antenna structure as claimed in claim 1 wherein each unit cell of said plurality of unit cells have said feed member of varying lengths.

6. The antenna structure as claimed in claim 1 wherein said second dielectric layer and said third dielectric layer have a higher dielectric constant than said first dielectric layer and said fourth dielectric layer.

7. A satellite antenna structure comprising:

a plurality of unit cells each having:

a first patch plane having a first patch;

a first ground plane adjacent to said first patch plane, said first ground plane having a top slot in operative communication with said first patch;

a feed member plane adjacent to said first ground plane, said feed member plane having a feed member in operative communication with said top slot;

a second ground plane adjacent to said feed member plane, said second ground plane having a bottom slot in operative communication with said feed member;

a second patch plane adjacent to said second ground plane, said second patch plane having a second patch in operative communication with said bottom slot;

a first dielectric layer interposed between said first patch plane and said first ground plane;

a second dielectric layer interposed between said first ground plane and said feed member plane;

a third dielectric layer interposed between said feed member plane and said second ground plane; and a fourth dielectric layer interposed between said second ground plane and said second patch plane.

8. The satellite antenna structure as claimed in claim 7 wherein said feed member has a first end positioned perpendicular to and substantially under said top slot, and a second end positioned perpendicular to and substantially over said bottom slot.

9. The satellite antenna structure as claimed in claim 8 wherein said first end and said second end are respectively orthogonal to each other.

10. The satellite antenna structure as claimed in claim 9 wherein said first patch plane and said second patch plane are symmetrically identical, and said first ground plane and said second ground plane are symmetrically identical.

11. The satellite antenna structure as claimed in claim 7 wherein each unit cell of said plurality of unit cells have said feed member of different lengths.

12. The satellite antenna structure as claimed in claim 7 wherein said second dielectric layer and said third dielectric layer have a higher dielectric constant than said first dielectric layer and said fourth dielectric layer.

13. The satellite antenna structure as claimed in claim 7 wherein each one of said plurality of unit cells comprise a second feed member and associated top and bottom slot wherein said feed members are separated by a plurality of holes conductively plated and extending through said second dielectric layer and said third dielectric layer thereby connecting the first ground plane with the second ground plane.

14. An antenna structure comprising:

a first patch plane having a first plurality of patches;

a first ground plane adjacent to said first patch plane, said first ground plane having a plurality of top slots wherein each of said plurality of top slots is in operative communication with at least one of said plurality of first patches;

a feed member plane adjacent to said first ground plane, said feed member plane having a plurality of feed members wherein each of said plurality of feed members is in operative communication with corresponds to each of said plurality of top slots;

a second ground plane adjacent to said feed member plane, said second ground plane having a plurality of bottom slots wherein each of said plurality of bottom slots is in operative communication with each of said plurality of feed members;

a second patch plane adjacent to said second ground plane, said second patch plane having a second plurality of second patches wherein each of said plurality of bottom slots is in operative communication with at least one of said second plurality of patches;

a first dielectric layer interposed between said first patch plane and said first ground plane;

a second dielectric layer interposed between said first ground plane and said feed member plane;

a third dielectric layer interposed between said feed member plane and said second ground plane; and a fourth dielectric layer interposed between said second ground plane and said second patch plane.

15. The antenna structure as claimed in claim 14 wherein each of said plurality of feed members have a first end and a second end and each of said plurality of top slots are positioned perpendicular to and substantially over said first end, and each of said plurality of bottom slots are positioned perpendicular to and substantially under said second end.

16. The antenna structure as claimed in claim 15 wherein said plurality of feed members comprises feed members of different lengths.

17. The antenna structure as claimed in claim 16 wherein said first end and said second end are positioned perpendicular to each other.

18. The antenna structure as claimed in claim 14 wherein said first patch plane and said second patch plane are symmetrically identical, and said first ground plane and said second ground plane are symmetrically identical.

19. The antenna structure as claimed in claim 14 wherein said second dielectric layer and said third dielectric layer have a higher dielectric constant than said first dielectric layer and said fourth dielectric layer.

20. The antenna structure as claimed in claim 14 further comprising a horn for emitting energy upon said second patch plane.

* * * * *